US006048059A

United States Patent [19]

Wafler

[11] Patent Number: 6,048,059

[45] Date of Patent: Apr. 11, 2000

[54] VARIABLE POWER PREHEATER FOR AN INK PRINTER

[75] Inventor: Walter F. Wafler, Pittsford, N.Y.

[73] Assignee: Xerox Corporation, Stamford, Conn.

[21] Appl. No.: 09/375,076

[22] Filed: Aug. 16, 1999

Related U.S. Application Data

[63] Continuation of application No. 08/854,734, May 12, 1997, abandoned.

[51] Int. Cl.[7] ..... B41J 2/01

[52] U.S. Cl. ..... 347/102; 347/16

[58] Field of Search ..... 347/102, 16

[56] References Cited

U.S. PATENT DOCUMENTS 5,296,873 3/1994 Russel et al. ..... 347/102

5,406,321 4/1995 Schwiebert et al. ..... 347/102

FOREIGN PATENT DOCUMENTS 2-179749 7/1990 Japan .

*Primary Examiner*—John Barlow
*Assistant Examiner*—Christina Annick
*Attorney, Agent, or Firm*—Robert A. Chittum

[57] ABSTRACT

A preheater is placed between a supply tray station and a print zone of an ink printer. Power to the preheater is varied so that the preheater is heated to a fist relatively high temperature during the time that the recording medium is advanced from the supply station to the print zone. When the recording medium enters the print zone, the medium is moved at a slower indexing speed, and the power to the preheater is reduced to a second level. The result is a more uniform application of preheat to the recording medium.

2 Claims, 2 Drawing Sheets

VARIABLE POWER PREHEATER FOR AN INK PRINTER

This application is a continuation of application Ser. No. 08/854,734, filed May 12, 1997 now abandoned.

BACKGROUND OF THE INVENTION AND MATERIAL DISCLOSURE STATEMENT

This invention relates generally to ink printers and, more particularly, to printers in which an aqueous ink is applied to a porous recording medium such as paper.

Liquid ink printers of the type frequently referred to as continuous stream or as drop-on-demand, such as piezoelectric, acoustic, phase change wax-based or thermal, have at least one printhead from which droplets of ink are directed towards a recording medium Within the printhead, the ink is contained in a plurality of channels. Power pulses cause the droplets of ink to be expelled as required from orifices or nozzles at the end of the channels.

In a thermal ink-jet printer, the power pulse is usually produced by a heater transducer or a resistor, typically associated with one of the channels. Each resistor is individually addressable to heat and vaporize ink in the channels. As voltage is applied across a selected resistor, a vapor bubble grows in the associated channel and initially bulges from the channel orifice followed by collapse of the bubble. The ink within the channel then retracts and separates from the bulging ink thereby forming a droplet moving in a direction away from the channel orifice and towards the recording medium whereupon hitting the recording medium a dot or spot of ink is deposited. The channel is then refilled by capillary action, which, in turn, draws ink from a supply container of liquid ink.

The ink jet printhead may be incorporated into either a carriage type printer, a partial width array type printer, or a page-width type printer. The carriage type printer typically has a relatively small printhead containing the ink channels and nozzles. The printhead can be sealingly attached to a disposable ink supply cartridge. The combined printhead and cartridge assembly is attached to a carriage which is reciprocated to print one swath of information (equal to the length of a column of nozzles), at a time, on a stationary recording medium, such as paper or a transparency. After the swath is printed, the paper is stepped a distance equal to the height of the printed swath or a portion thereof, so that the next printed swath is contiguous or overlapping therewith This procedure is repeated until the entire page is printed. In contrast, the page width printer includes a stationary printhead having a length sufficient to print across the width or length of a sheet of recording medium at a time. The recording medium is continually moved past the page width printhead in a direction substantially normal to the printhead length and at a constant or varying speed during the printing process. Partial width array printers are disclosed, for example, in U.S. Pat. No. Re. 32,572 and U.S. Pat. No. 4,638,337. A page width ink-jet printer is described, for instance, in U.S. Pat. No. 5,192,959. These patents are hereby incorporated by reference.

Many liquid inks and particularly those used in thermal ink jet printing, include a colorant or dye and a liquid which is typically an aqueous liquid vehicle, such as water, and/or a low vapor pressure solvent. The ink is deposited on the substrate to form an image in the form of text and/or graphics. Once deposited, the liquid component is removed from the ink and the paper to fix the colorant to the substrate by either natural air drying or by active drying. In natural air drying, the liquid component of the ink deposited on the substrate is allowed to evaporate and to penetrate into the substrate naturally without mechanical assistance. In active drying, the recording medium is exposed to heat energy of various types which can include infrared heating, conductive heating and heating by microwave energy.

Active drying of the image can occur either during the imaging process or after the image has been made on the recording medium. In addition, the recording medium can be preheated before an image has been made to precondition the recording medium in preparation for the deposition of ink. Preconditioning of the recording medium typically prepares the recording medium for receiving ink by driving out excess moisture which can be present in a recording medium such as paper. Not only does this preconditioning step reduce the amount of time necessary to dry the ink once deposited on the recording medium, but this step also improves image quality by reducing paper cockle and curl which can result from too much moisture remaining in the recording medium.

Various drying mechanisms for drying images deposited on recording mediums are illustrated and described in the following disclosures which may be relevant to certain aspects of the present invention.

U.S. Pat. No. 5,005,025, to Miyakawa et al., describes an ink jet recording apparatus for recording which fixes ink through evaporation of an ink solvent. The apparatus includes a heating member extending both upstream and downstream with respect to a recording area and a conveying direction of the recording sheet. The heating member contacts the recording sheet to assist in the fixation of the ink.

U.S. Pat. No. 5,406,321, to Schwiebert et al., describes an ink jet printer and a paper preconditioning preheater therefore. The paper preconditioning preheater has a curved surface and a multi-purpose paper path component to accomplish direction reversal for the paper. The paper contacts the preheater which dries and shrinks the paper to condition it for a printing operation. The preheater is a thin flexible film carrying heater elements which is suspended in air to provide extremely low thermal mass and eliminate the need for long warm up times.

U.S. Pat. No. 5,296,873 to Russell et al. discloses a paper preconditioning preheater in the form of a preheated drive roller which engages the medium and drives it into the print zone.

Copending application U.S. Ser. No. 08/523,322 assigned to the same assignee of the present invention, discloses a segmented heater which includes a curved preheater segment and a planer segment positioned in the print zone. All of the above-identified references are hereby incorporated by reference.

A continuing problem with printer designs which include a recording medium preheating function is the unevenness of the medium warm up as it moves from a medium supply station into the ink print zone. Referring to the prior art design shown in FIG. 1, a recording medium 10 is moved from a supply tray 12 by feed roller 14. Medium 10 is conveyed across the top surface of a heater 16 which is powered by a power supply 18 creating a current in the heater, which may be, but is not limited to, a foil or other type of heating mechanism, and increasing the temperature thereof The medium is moved into a print zone 20, where an ink jet cartridge 22 comprising a printhead 24, connected to an ink reservoir 26, is pulsed by input signals from drive circuit 28 to cause ink droplet ejection in an image-wise pattern on the medium. The medium is advanced into the print zone by drive roller 30 cooperating with a pinch roller 32. The cartridge is moved by a carriage (not shown) back and forth (into and out of the page) and the medium is incrementally advanced following formation of each image line.

Medium 10 is typically advanced quickly along the path extending from the lip of the supply tray (point A) to the nip formed by roller pairs 34, 36 (point B). This initial rapid advance of the medium is done to minimize interprint time and reduce the first print out time. Once the leading edge of the medium enters the print zone, the medium moves through the print zone at the normal medium indexing time (the medium is held stationary until a line is recorded and then indexed forward). It will be appreciated that the first leading portion of the medium (distance from A to B) will be warmed less than the trailing portion of the medium (distance A to the trailing edge). This unequal heating of the paper can lead to differential print quality problems for the first portion of each recorded medium.

SUMMARY OF THE INVENTION

According to the invention, a more even heating of the recording medium is provided by increasing the power to the preheater during the time that the forward portion of the medium is moving from a feed position into the print zone. Thus, the first portion of the medium is heated at a greater rate to provide a more uniform heating of the entire medium.

More particularly, the present invention relates to a printing machine for printing on a recording medium moving along a path from a supply station to a print zone, comprising:

- a printhead for depositing ink on the recording medium;
- a preheater disposed adjacent to said path, for preheating the recording medium,
- a power supply for applying power to said preheater and
- a controller for varying the power output of said power supply so as to supply a first power input to the preheater during a first time period when the medium is moving from the supply station to the print zone and a second relatively lower power input to the preheater during a second time period that the medium is moving through the print zone.

DESCRIPTION OF THE INVENTION

Figure 1:
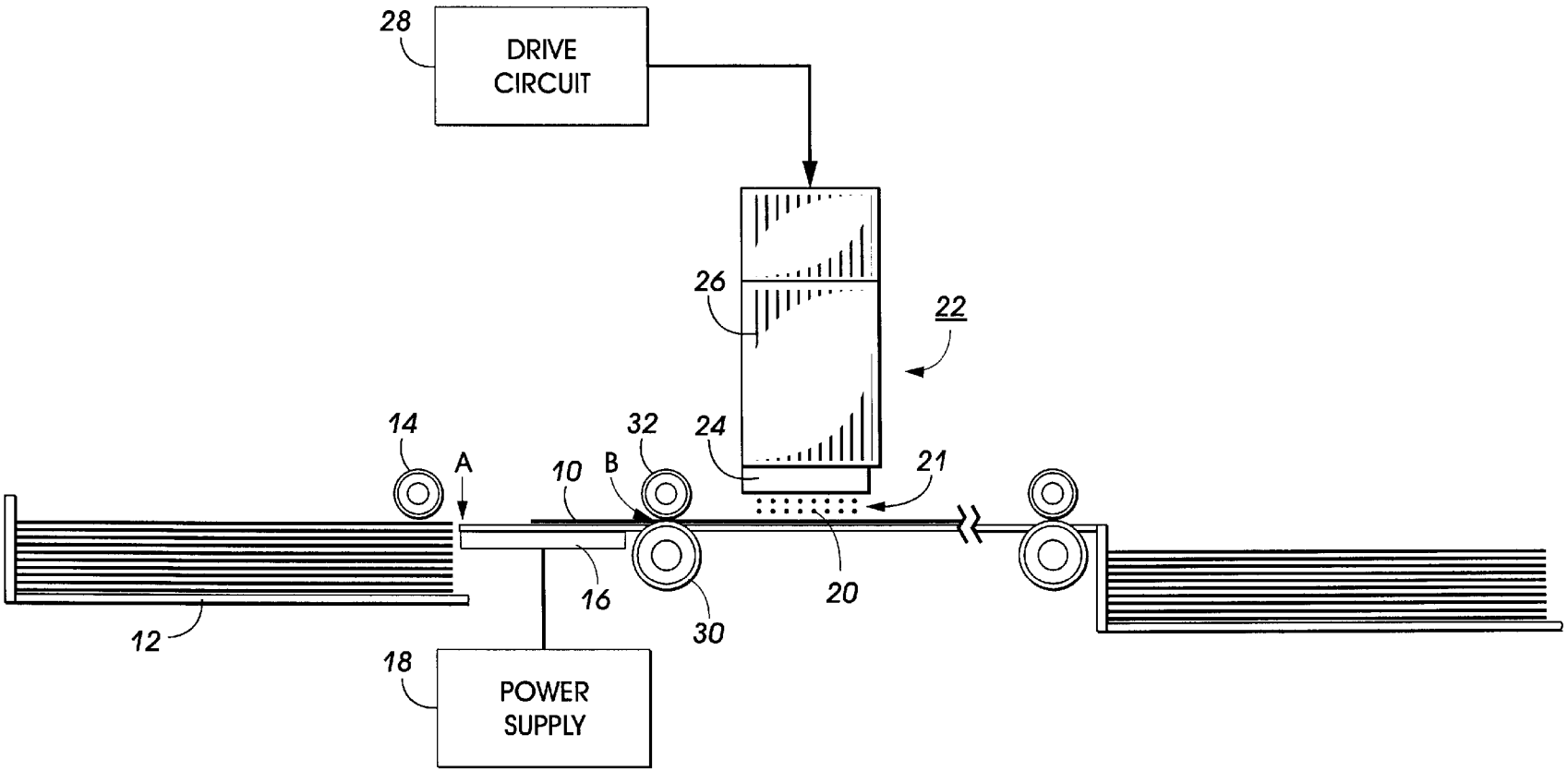
FIG. 1 PRIOR ART
FIG. 1 shows a prior art preheating system for a thermal ink jet printer.
Figure 2:
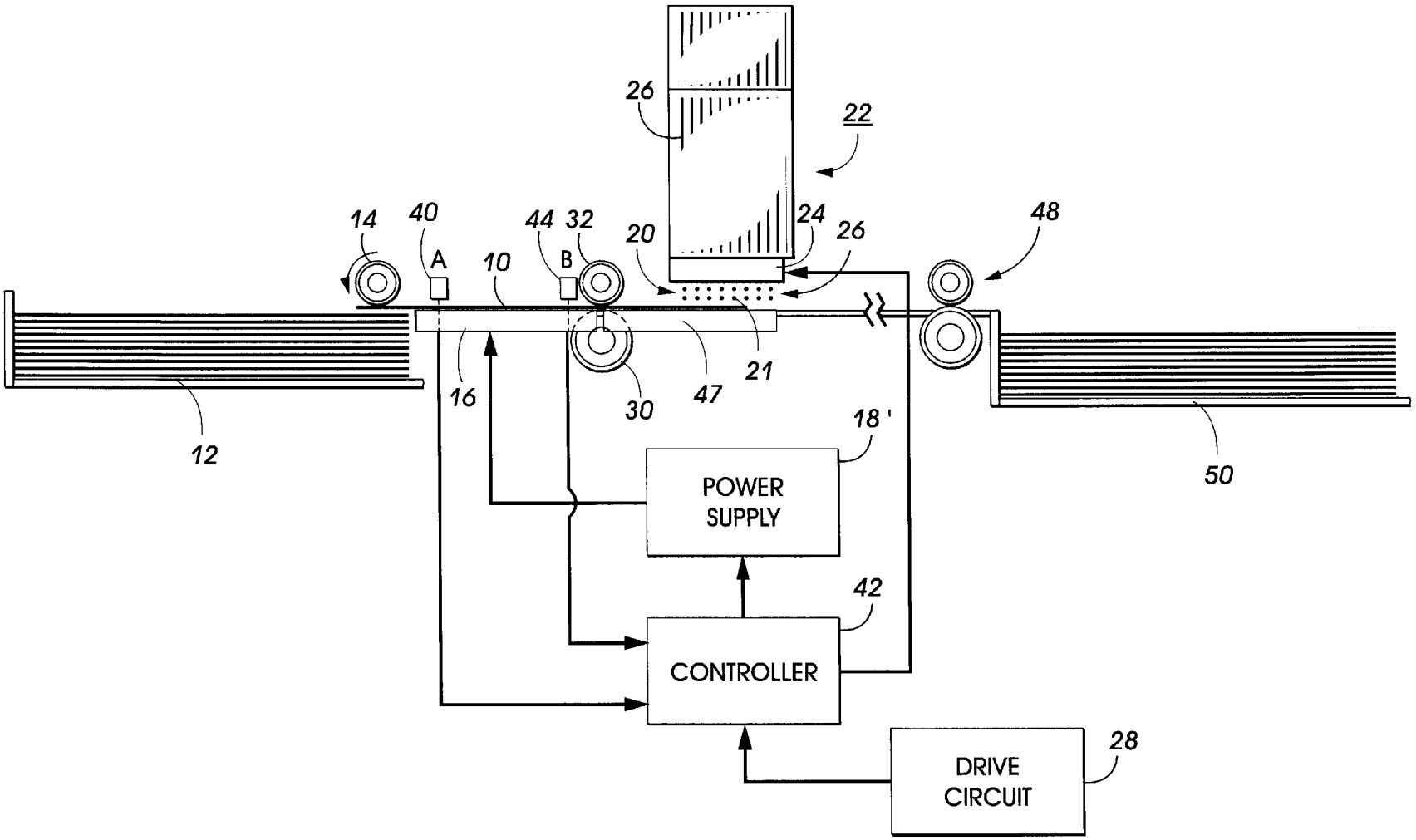
FIG. 2 shows a preheating system of the invention including a variable power supply system which applies a variable power input to the preheater.

Although the present invention discussed here may be used for drying an image which is created by any type of liquid ink printer, the following description is directed towards an environment of a thermal ink jet printer such as that shown in FIG. 1 and modified as in FIG. 2.

FIG. 2 shows a preferred embodiment of the invention wherein the prior art design of FIG. 1 is modified by varying the output of a power supply 18' to selectively increase the power applied to a preheater 16.

As in the FIG. 1 prior art design, a recording medium 10, which can be a paper sheet, is moved out of supply tray 12 by feed roller 14. The tray is spring biased by conventional means to force the top sheet of the stack into contact with the feed roller. The first portion of sheet 10 moves along preheater 16, which can be any conventional heater such as, for example, a foil type heater. The preheater preheats the sheet and removes excess moisture from the paper resulting in a more dimensionally stable sheet as well as improving ink absorption into the paper. (Transparencies and certain coated papers do not require preheating and, in fact, can be damaged by excess preheating because of softening.) As the leading edge of the sheet passes beneath a sensor 40, a first signal is sent to controller 42 which controls the power output of power supply 18'. The power output is at a first high preheat power level, which brings the current applied to preheater 16 to a predetermined level resulting in the paper being heated at a first predetermined level When the leading edge of sheet 10 passes beneath a second sensor 44, a second signal is generated and sent to controller 42. Controller 42 sends a signal to power supply 18' reducing the power output to a second preheat level lower than that of the first output power level resulting in the paper being heated at a second level lower than said first level This power cycling sequence is repeated with succeeding sheets of paper being fed from tray 12.

The print zone 20 is the area directly beneath the printhead 12 where droplets of ink 21 are deposited by an array of ink nozzles printing a swath of information and arranged on a front face of the printhead. The front face of the printhead is substantially parallel to the recording medium. A carriage traveling orthogonally to the recording medium deposits the ink droplets upon the recording medium in an imagewise fashion. The medium is supported by a platen member 47. The printhead 24 receives ink from attached ink tank 26. The image deposited upon the recording medium can include text and/or graphic images, the creation of which is controlled by controller 42, in response to electrical signals from drive circuit 28. A printer of this type is disclosed in the patents referenced supra; e.g., U.S. Pat. No. Re. 32,572 and U.S. Pat. No. 4,638,337. Before the paper 10 has been released from drive roll 30 and the pinch roll 32, an exit drive roll/pinch roll combination 48 captures the leading edge of sheet 10 for transport to output tray 50 which holds printed recording medium.

Typically, the normal print time per swath is determined by the firing rate of the printhead and the width of the printhead. The nominal power input to the paper depends on print speed and other factors such as type of ink and the medium. The preheat time decreases as the paper feed speed increases (to minimize the interprint time). The amount of time the paper is exposed to the heater requires additional power to compensate. The increase in power is approximately inversely proportional to the advanced rate of feed of the paper (rate of movement from point A to point B) versus the nominal advance speed through the print zone. Or, stated another way, the ratio of the first power level to the second power level is directly proportional to the ratio of the first time period $t_1$ to the second time period $t_2$. For example, assumed that the nominal advance speed through the print zone is one inch/second, and the power level for the second preheat level is 10 watts. If the advance rate is six inches/second, then the first power output level is 60 watts; thus, the power applied to preheater 16 upon generation of signal inputs from sensor 40 is 60 watts heating the paper advancing at six inches/second to a first, relatively high, temperature level. The power to preheater 16 drops to 10 watts upon generation of a signal from sensor 44 and remains at that level until the next sheet is moved out of tray 12 and is sensed by sensor 40. These parameters are variable depending on the heat transfer characteristics of the preheater.

To summarize the above, the printing quality of the image recorded on medium 10 is improved by preheating the first portion of the medium as it advances to the print zone at a higher temperature than the temperature applied to the remaining portion of the sheet. The first temperature is maintained for a shorter time than the second temperature with the result that an appropriate uniform preheat temperature is applied to the entire sheet.

Various modifications may be made consistent with the invention. As an example, the platen support member 47 may be separately heated to provide additional moisture removal from the medium. Although the preheater is shown as a planar member, it may also take other configurations such as a curved preheater of the type disclosed in aforementioned copending U.S. Ser. No. 08/523,322. Further, in regard to the control system in controller 42, it is well known, and normally preferable, to program and execute imaging, printing, document, and/or paper handling control functions and logic with software instructions for conventional or general purpose microprocessors. This is taught by various prior patents and commercial products. Such programming or software may, of course, vary depending on the particular functions, software type, and microprocessor or other computer system utilized, but will be available to, or readily programmable without undue experimentation from, functional descriptions, such as those provided herein, or prior knowledge of functions which are conventional, together with general knowledge in the software and computer arts. "Object oriented" software development environments, such as C++, can even provide portable source code. Alternatively, the disclosed system or method may be implemented partially or fully in hardware, using standard logic circuits or a single chip using VLSI designs.

While the embodiment disclosed herein is preferred, it will be appreciated from this teaching that various alternative, modifications, variations or improvements therein may be made by those skilled in the art, which are intended to be encompassed by the following claims:

What is claimed is:

1. An ink jet printer having means for preheating a recording medium prior to entry into a print zone of the printer, comprising:

a printhead located at said print zone for depositing ink droplets on the recording medium as the recording medium moves through said print zone;

means for moving the recording medium from a supply tray to a drive roller located adjacent the print zone, the moving means moving the recording medium at a first rate of speed;

said drive roller being adapted to advance the recording medium through the print zone at a second rate of speed which is slower than the first rate of speed;

a variable power preheater disposed adjacent the drive roller such that the drive roller is located between the preheater and print zone, with the print zone being downstream from the preheater, the preheater heating the recording medium as the recording medium moves there past;

a first sensor for detecting the presence of the recording medium as the recording medium moves from the supply tray and for generating a first signal;

a power supply for applying power to said preheater;

a controller for varying the power output of said power supply so as to supply a first power input to the preheater in response to receipt of the first signal from the first sensor;

a second sensor for detecting the presence of the recording medium upon arrival of the recording medium at the drive roller and for generating a second signal; and said controller varying the power output of said power supply so as to supply a second power input to the preheater in response to receipt of the second signal from the second sensor, the second power input being lower than the first power input, so that a portion of the recording medium is not overly preheated while the drive roller advances the recording medium through the print zone at said second rate of speed.

2. A method for preheating a recording medium advancing from a recording medium supply station to and through a print zone of an ink jet printer, including the steps of;

moving the recording medium at a first rate of speed from the supply station to a recording medium drive means located adjacent the print zone;

advancing the recording medium by said drive means into and through the print zone at a second rate of speed which is slower than the first rate of speed;

providing a variable power preheater adjacent said drive means, so that the drive means is positioned between said preheater and said print zone and said print zone is down stream from the preheater;

sensing the presence of said recording medium as the recording medium moves from the supply station and generating a first signal;

applying a first power input to the preheater in response to said first signal to produce a first temperature by the preheater;

sensing the presence of said recording medium when the recording medium arrives at the drive means and generating a second signal; and applying a second power input to the preheater in response to said second signal to produce a second temperature by the preheater, the second temperature being lower than the first temperature, so that the slower rate of speed of the recording medium, as the recording medium is advanced through said print zone, does not cause a portion of the said recording medium to become over heated by said preheater.

* * * * *